US007902445B2

(12) United States Patent
Sugimoto et al.

(10) Patent No.: US 7,902,445 B2
(45) Date of Patent: Mar. 8, 2011

(54) HOUSING STRUCTURE OF ELECTRONIC KEYBOARD MUSICAL INSTRUMENT

(75) Inventors: Ryotaro Sugimoto, Shizuoka (JP); Takeshi Ando, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/952,981

(22) Filed: Dec. 7, 2007

(65) Prior Publication Data

US 2008/0156170 A1 Jul. 3, 2008

(30) Foreign Application Priority Data

Dec. 27, 2006 (JP) ..... 2006-352190
Dec. 27, 2006 (JP) ..... 2006-352191

(51) Int. Cl.
*G10C 3/12* (2006.01)

(52) U.S. Cl. ..... 84/423 R; 312/198

(58) Field of Classification Search ..... 84/423 R; 312/107, 198
See application file for complete search history.

(56) References Cited

U.S. PATENT DOCUMENTS 4,254,684 A 3/1981 Helpinstill, III
7,659,470 B2 2/2010 Sugimoto et al.
2004/0182223 A1 * 9/2004 Kuwahara et al. ..... 84/423 R

FOREIGN PATENT DOCUMENTS

JP 62-103382 U 7/1987
JP 2003-264381 9/2003

* cited by examiner

*Primary Examiner* — Jianchun Qin
(74) *Attorney, Agent, or Firm* — Morrison & Foerster LLP

(57) ABSTRACT

A housing structure of an electronic keyboard musical instrument, in which a pivotable upper case can be mounted to and dismounted from a lower case when the upper case is in a semi-open state, thereby improving safety and the working efficiency at the time of assembly and maintenance. Pivot coupling parts each include an engagement protrusion comprised of a narrow-width portion and a wide-width portion. An upper case is formed with engagement holes each comprised of a narrow-width counterpart permitting the narrow-width portion to be inserted thereinto and a wide-width counterpart permitting the wide-width portion to be inserted thereinto. By moving the upper case, having a posture thereof corresponding to a mountable/dismountable angle range, in the direction in which the wide-width portions project, the wide-width portions can be inserted into and removed from the wide-width counterparts.

3 Claims, 15 Drawing Sheets

HOUSING STRUCTURE OF ELECTRONIC KEYBOARD MUSICAL INSTRUMENT

BACKGROUND OF THE INVENTION

1. Field of the Invention

The present invention relates to a housing structure of an electronic keyboard musical instrument, which includes a housing adapted to be completed by fixing an upper case to a lower case.

2. Description of the Related Art

A conventional housing structure of an electronic keyboard musical instrument generally includes upper and lower cases formed separately from each other and fixedly fastened together by fastening means. However, with the housing structure having upper and lower cases completely separated from each other before being fastened together, these must be placed in different places during assembly for production and maintenance for services, resulting in a low efficiency of working space.

There is also known a housing structure including upper and lower cases separately formed and coupled for pivotal motion relative to each other. For example, a housing disclosed in Japanese Laid-open Utility Model Registration No. 62-103382 includes an upper case pivotable between open and closed states relative to a lower case around a hinge provided at the rear of the housing. This housing is completed by fixing the upper case to the lower case by screws or the like, with the upper case kept retained in a closed state.

However, according to the above-described housing disclosed in Japanese Laid-open Utility Model Registration No. 62-103382 in which the upper and lower cases are coupled by a hinge, it is not easy to release the coupling therebetween to separate them from each other.

Thus, it is difficult to, for example, mount component parts to the housing after the upper case has been fixed to the lower case. In some cases, the sequence of operations is therefore restricted such that component parts must be mounted to the housing before the upper and lower cases being coupled together.

Since the upper and lower cases being coupled together by a hinge are difficult to uncouple, it is inconvenient for an operator to see the interior of the housing for maintenance purpose, for example, resulting in low workability.

On the other hand, in the case of using, instead of a hinge, a pivotal coupling device for pivotably coupling upper and lower cases together, safety cannot be assured if the pivotal coupling is unintentionally decoupled when the upper case is open. Furthermore, if the pivotal coupling is unintentionally decoupled when the upper case is closed, the upper and lower cases are misaligned in position, which makes it difficult for an operator to again fasten them together.

Conventionally, there has also been known a housing structure of an electronic keyboard musical instrument, in which upper and lower cases are formed separately from each other and a housing is completed by fixedly mounting the upper case to the lower case (Japanese Patent Publication No. 3821022). In a housing structure of this type, the upper and lower cases are generally fastened together by fastening means such as screws applied from above or from below.

To fix the upper and lower cases together, these must be fixed after being arranged in a proper positional relation. In some electronic keyboard musical instrument, arms and side beds are fixed beforehand to the upper case, and key slips and a keyboard unit are fixed beforehand to the lower case. In such a musical instrument, if a positional accuracy between the upper and lower cases is low, gaps between the keyboard unit and the side beds become nonuniform between left and right sides of the instrument or vary depending on position in the forward-to-backward direction of the instrument. On the other hand, in a musical instrument having a keyboard unit fixed beforehand to the upper case, if the positional accuracy between the upper and lower cases is low, gaps between key slips and the keyboard unit and between the key slip and side beds become inappropriate. Thus, it is necessary to fix the upper and lower cases together while adjusting the gaps.

When the upper and lower cases are fixed by screws or the like inserted from below, there is a problem of requiring cumbersome operations. Specifically, the upper and lower cases are first turned upside down for being fixed together and then turned right side up to visually check whether the gaps are uniform between the left and right sides of the musical instrument. If the gaps are not uniform, the upper and lower cases are turned upside down to perform the fixing operation again.

When the upper and lower cases are fixed by screws inserted from above, it is unnecessary to turn the upper and lower cases upside down. However, the screws or other fastening means become visible from above even after completion of assembly of the housing, posing a problem of inferior external appearance.

SUMMARY OF THE INVENTION

The present provides a housing structure of an electronic keyboard musical instrument, which includes a pivotable upper case capable of being easily mounted to or dismounted from a lower case only when the upper case is in a semi-open state, to thereby improve safety and working efficiency at the time of assembly and maintenance.

The present invention also provides a housing structure of an electronic keyboard musical instrument, in which upper and lower cases can be fixed together in a state that they are turned right side up, and case fasteners can be covered by arms to achieve a natural look, thereby improving external appearance.

According to a first aspect of this invention, there is provided a housing structure of an electronic keyboard musical instrument having a housing comprised of lower and upper cases which are separate from each other, the upper case being adapted to be pivoted relative to the lower case between open and closed states and the housing being completed by fixing the upper case which is in the closed state to the lower case, comprising at least one protrusion fixedly formed in either one of rear end portions of the upper and lower cases, and at least one engagement hole formed in another of the rear end portions of the upper and lower cases, wherein the upper and lower cases are adapted to be pivoted relative to each other in an opening and closing direction around an engagement portion between the engagement hole and the protrusion inserted into and engaged with the engagement hole, and wherein the protrusion and the engagement hole are adapted to be relatively inserted into and removed from each other in a direction in which the protrusion is projectedly formed only when the upper case is at a predetermined pivotal angle in a pivotal movement in the opening and closing direction.

With the housing structure according to the first aspect of this invention, the pivotable upper case can be made easily mountable to and dismountable from the lower case only when the upper case is in a semi-open state, making it possible to improve safety and the working efficiency of assembly and maintenance.

In this invention, the protrusion can include a narrow-width portion and a wide-width portion, the wide-width portion being arranged on a side close to a tip end of the protrusion with respect to the narrow-width portion and having a length longer than that of the narrow-width portion as viewed in a key arrangement direction, the engagement hole can include a wide-width counterpart having a width permitting the wide-width portion of the protrusion to be inserted thereinto, and a narrow-width counterpart formed adjacent to the wide-width counterpart and having a width not permitting the wide-width portion to be inserted thereinto but permitting the narrow-width portion to be inserted thereinto, the wide-width portion can be adapted to be insertable into and removable from the wide-width counterpart when the upper case having a posture corresponding to the predetermined pivotal angle and the lower case are relatively moved in a direction in which the protrusion is projectedly formed, and the protrusion and the engagement hole can be prevented from being relatively inserted into and removed from each other in the direction in which the protrusion is projectedly formed due to engagement between the wide-width portion and the narrow-width counterpart when the upper case is in the open state.

In that case, it is possible to prevent the upper case, which is in the open state, from being unintentionally dismounted from the lower case.

The protrusion can be projectedly formed to obliquely extend upwardly and forwardly or rearwardly from the rear end portion of the lower case, the engagement hole can be formed in the rear end portion of the upper case, and when the upper case is in the closed state, the protrusion and the engagement hole can be prevented from being relatively inserted into and removed from each other in the direction in which the protrusion is projectedly formed due to engagement between the rear end portions of the upper and lower cases and engagement between an inclined front or rear surface of the protrusion and the engagement hole.

In that case, the upper case which is in a closed state can be prevented from being unintentionally dismounted from the lower case.

The protrusion can be projectedly formed to obliquely extend upwardly and rearwardly from the rear end portion of the lower case, the engagement hole can be formed in the rear end portion of the upper case, and the upper case can be adapted to be kept maintained in the open state due to engagement between the narrow-width portion of the protrusion and the narrow-width counterpart of the engagement hole and direct or indirect engagement between the rear end portion of the upper case and a rear surface of the rear end portion of the lower case when the upper case in the open state.

In that case, the upper case can be made to be stably supported, thereby improving workability and safety.

According to a second aspect of this invention, there is provided a housing structure of an electronic keyboard musical instrument having a housing comprised of lower and upper cases which are separate from each other, the housing being completed by fixedly mounting the upper case to the lower case, comprising upper fastening portions provided in left and right side portions of the upper case, lower fastening portions provided in left and right side portions of the lower case and adapted to face the upper fastening portions of the upper case when the upper case is positioned in a position for being mounted to the lower case, and left and right arms formed separately from the upper and lower cases, respectively, wherein the upper fastening portions of the upper case and the lower fastening portions of the lower case are fastened together by case fasteners applied from above, with the upper case positioned in the position for being mounted to the lower case, and wherein the left and right arms are fastened, from left and right sides, to the left and right side portions of at least one of the upper and lower cases, respectively, so as to cover the case fasteners to be invisible.

With the housing structure according to the second aspect of this invention, the upper and lower cases can be fixed together with these cases turned right side up, and the case fasteners can be made invisible by the arms so as to achieve a natural look, thereby improving the external appearance.

The upper and lower fastening portions can be provided to project leftward and rightward from the upper and lower cases, respectively, and the left and right arms can be formed with run-off portions into which the upper and lower fastening portions on the left and right sides are fitted, respectively.

In that case, the entire fastening portions can be made invisible, thereby further improving the external appearance.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1A:
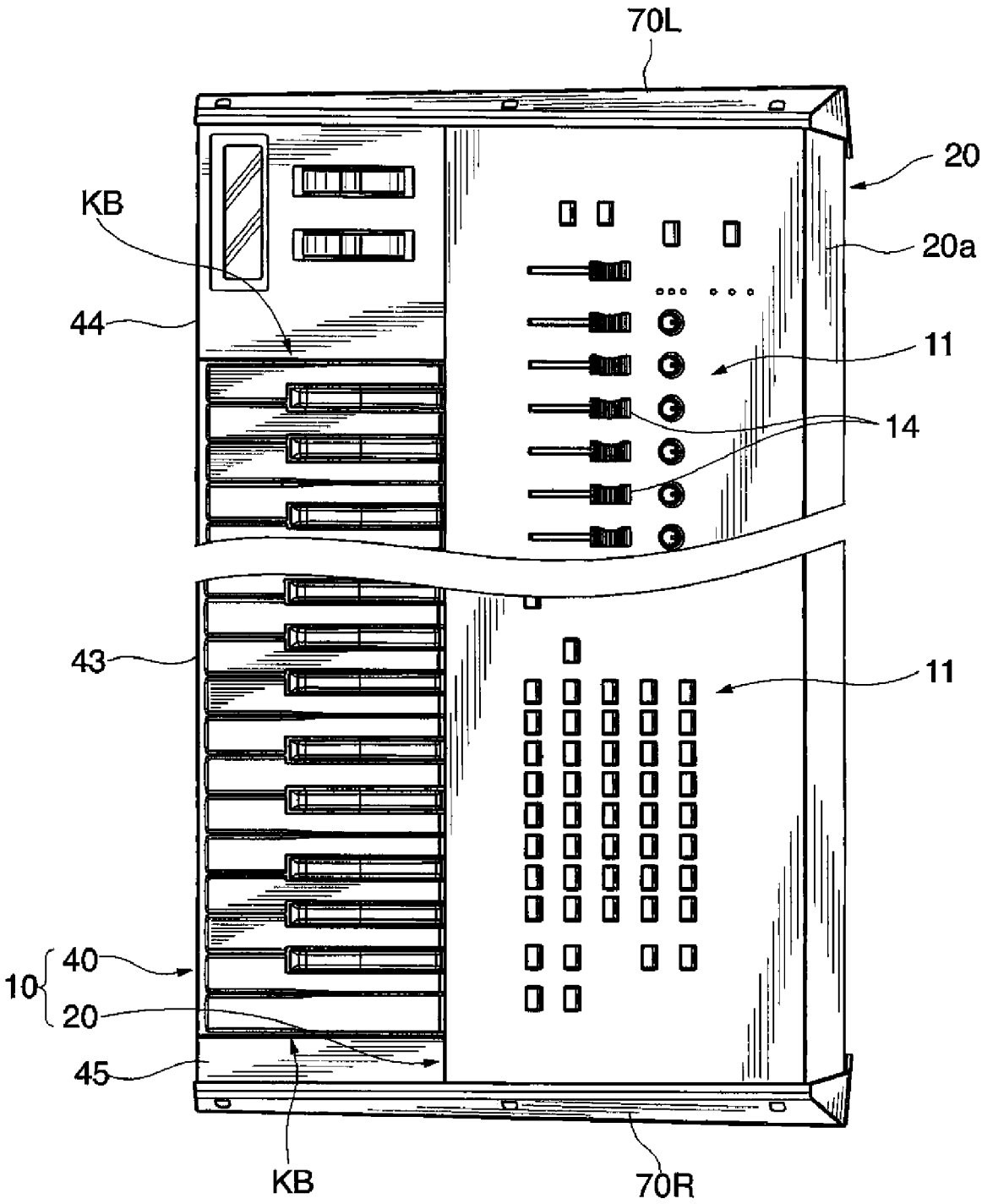
FIG. 1A is a plan view of an electronic keyboard musical instrument to which is applied a housing structure according to one embodiment of this invention.
Figure 1B:
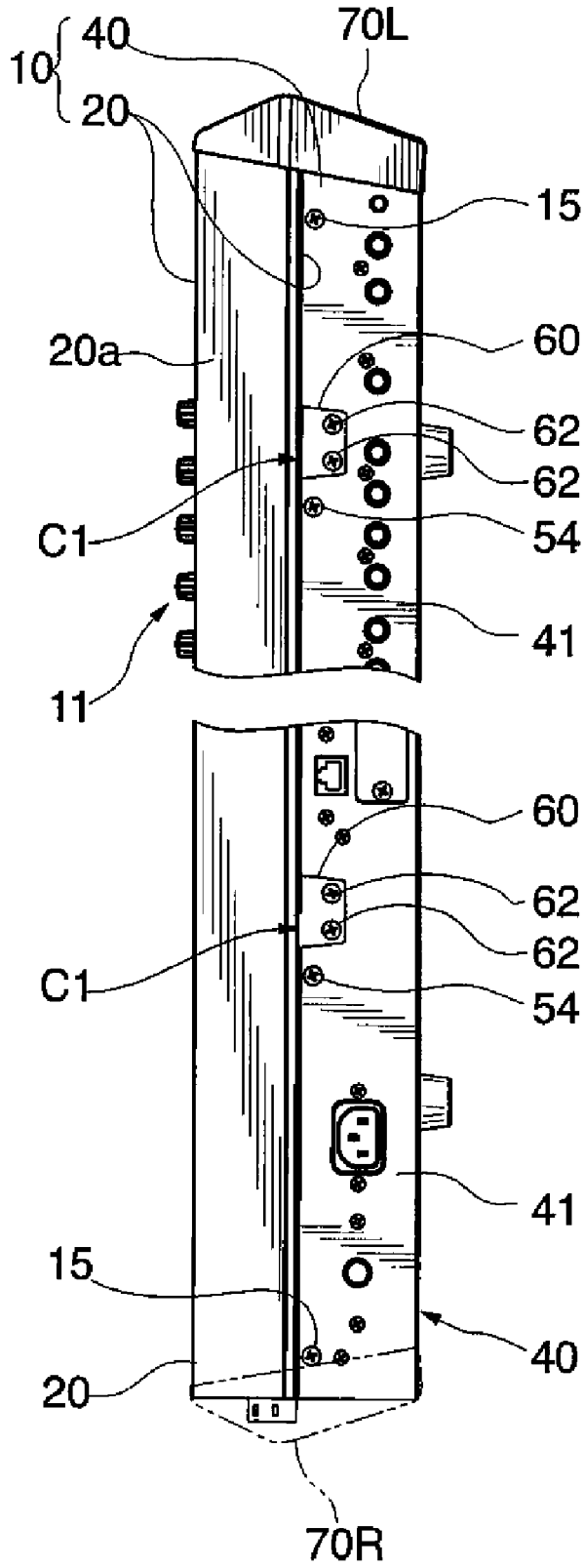
FIG. 1B is a rear view of the musical instrument.

FIG. 1A shows in plan view an electronic keyboard musical instrument to which a housing structure of one embodiment of this invention is applied, and FIG. 1B shows the musical instrument in rear view. This keyboard musical instrument is provided at its front side with an keyboard unit KB which a player faces. In the following, the left-to-right direction of the instrument is determined in reference to the player. The electronic keyboard musical instrument has a housing 10 comprised of a lower case 40 to which an upper case 20 is mounted, and arms 70 (70L, 70R) are mounted to left and right sides of the housing 10.

Figure 2A:
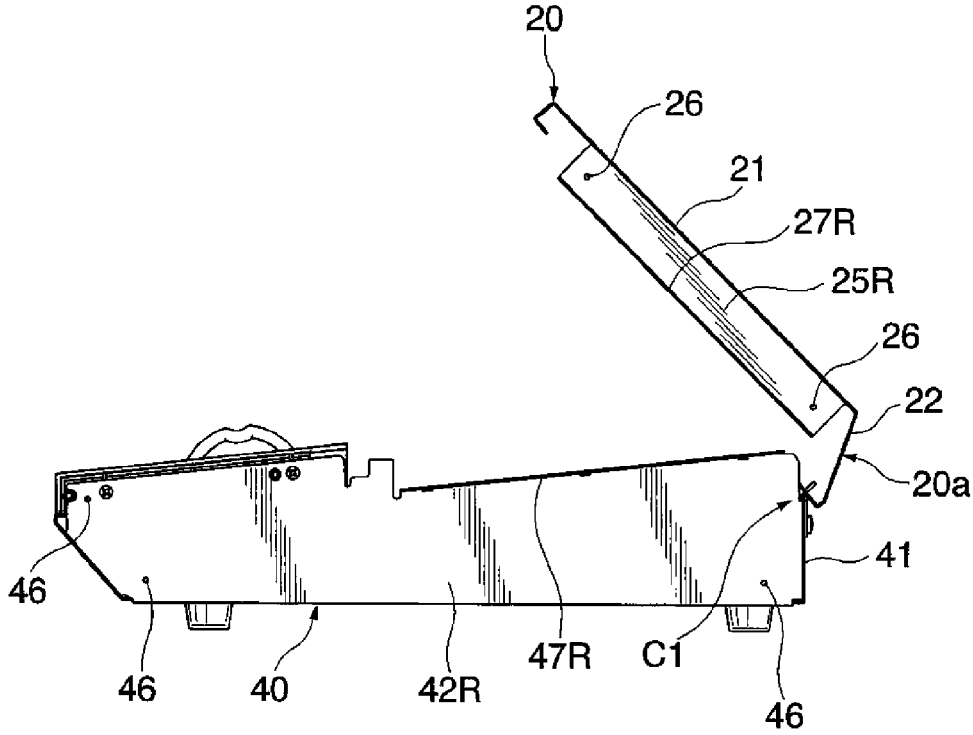
FIG. 2A is a right side view showing the keyboard musical instrument in a state where an upper case is being mounted to a lower case.
Figure 2B:
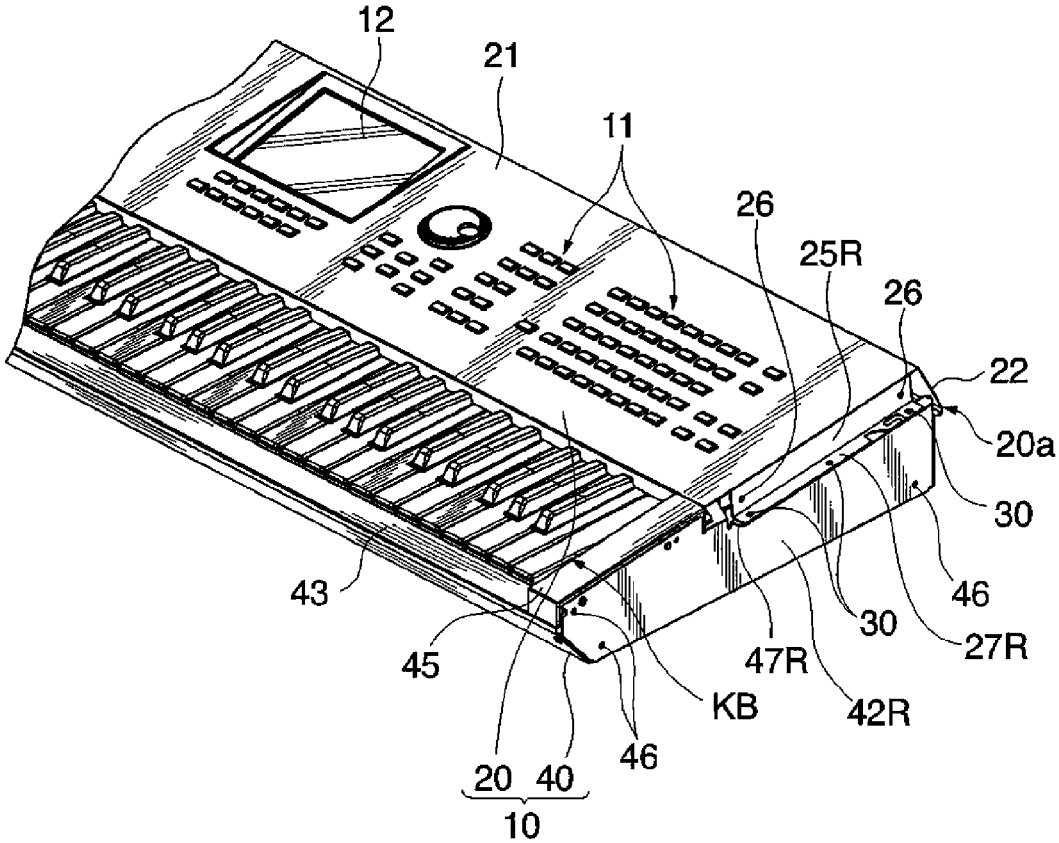
FIG. 2B is a schematic view showing a right half of the musical instrument in a state that the upper case has been temporarily mounted to the lower case but has not been fixedly fastened thereto.

FIG. 2A shows in right side view the keyboard musical instrument in a state that the upper case 20 is being mounted to the lower case 40, and FIG. 2B shows in perspective view a right half of the musical instrument in a state that the upper case 20 has been mounted to the lower case 40 but has not been fixedly fastened to the lower case 40. In the states shown in FIGS. 2A and B, the arms 70 have not been mounted to the housing 10.

Figure 3A:
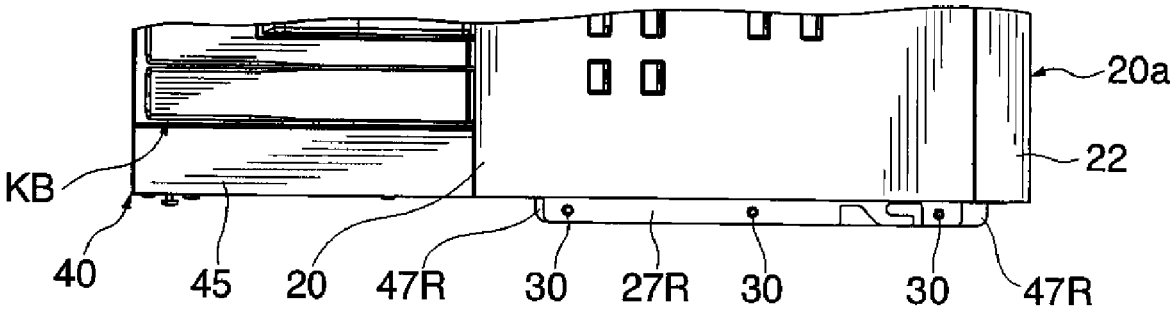
FIG. 3A is a plan view showing a right side portion of the keyboard musical instrument in a state that the upper case has been temporarily mounted to the lower case but arms have not been mounted to a housing.
Figure 3B:
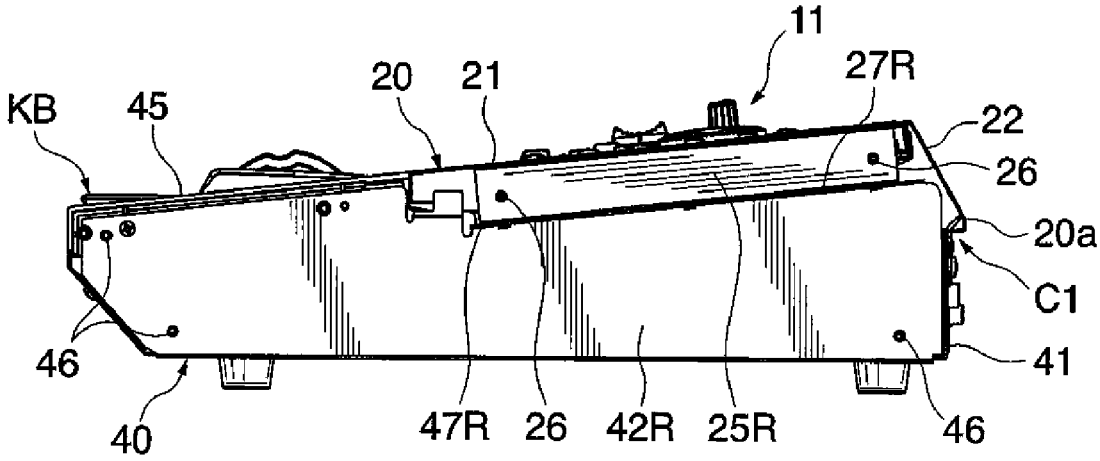
FIG. 3B is a right side view showing the musical instrument in the just-mentioned state.
Figure 3C:
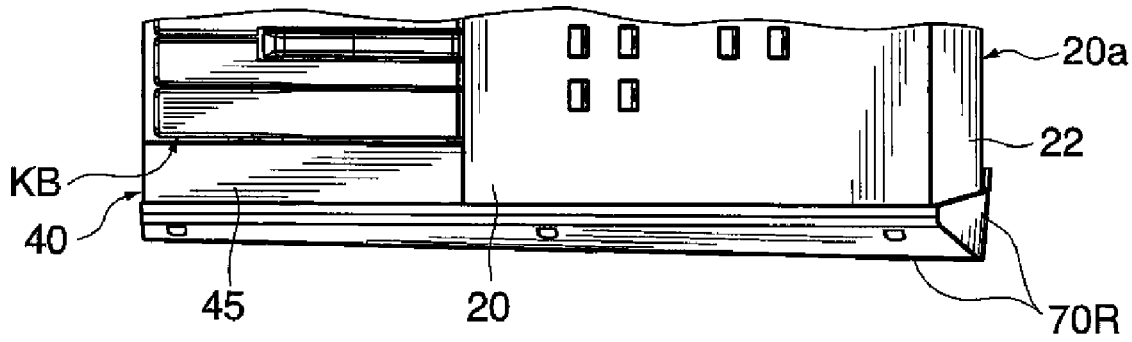
FIG. 3C is a plan view showing the right side portion of the musical instrument in a state that the upper case and the arms have been mounted to the lower case and the housing.
Figure 3D:
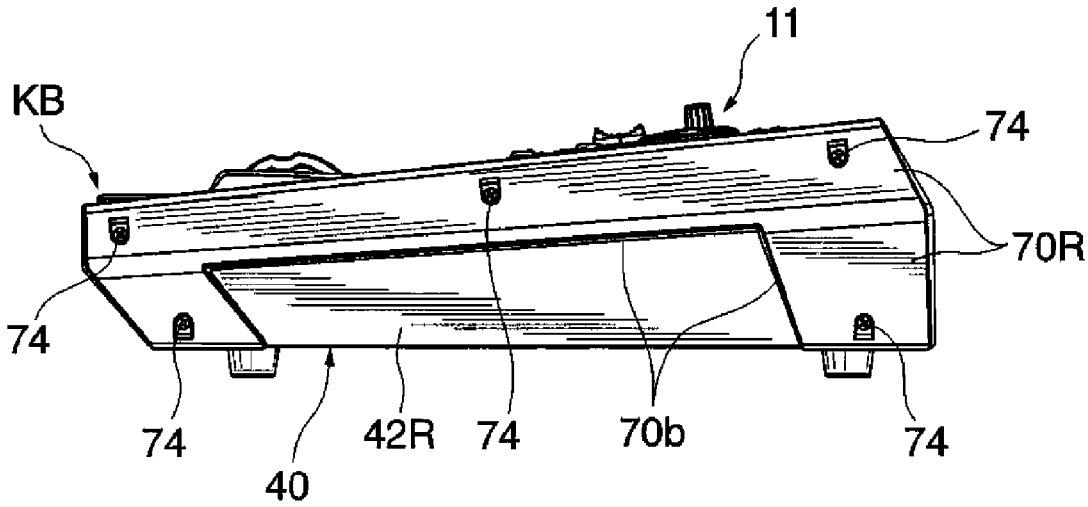
FIG. 3D is a right side view showing the musical instrument in the just-mentioned state.

FIG. 3A shows in plan view a right side portion of the keyboard musical instrument in a state that the upper case 20 has temporarily been mounted to the lower case 40 but the arms 70 have not been mounted to the housing 10, and FIG. 3B shows in a right side view the musical instrument in the just-mentioned state. FIG. 3C shows in plan view the right side portion of the musical instrument in a state that the upper case 20 and the arms 70 have been mounted to the lower case 40 and the housing 10, and FIG. 3D shows in right side view the musical instrument in that state.

Each of the upper and lower cases 20, 40 is made of metal, but may be made of a resin. The upper case 20 is fabricated separately from the lower case 40. When the upper case 20 has been mounted to the lower case 40, two left and right pivot coupling parts C1 are formed mainly by an upper portion of a rear plate 41 (a rear end portion) of the lower case 40 and a rear end portion 20*a* of the upper case 20 (refer to FIGS. 1B, 2A, and 3B). The upper case 20 is pivotable relative to the lower case 40 around the pivot coupling parts C1 in an opening and closing direction. In the state mounted to the lower case 40, the upper case 20 is located above a rear half of the lower case 40. The upper case 20 can be opened clockwise in FIG. 2A. The construction of the pivot coupling parts C1 will be described below with reference to FIGS. 6 to 10B.

Figure 4A:
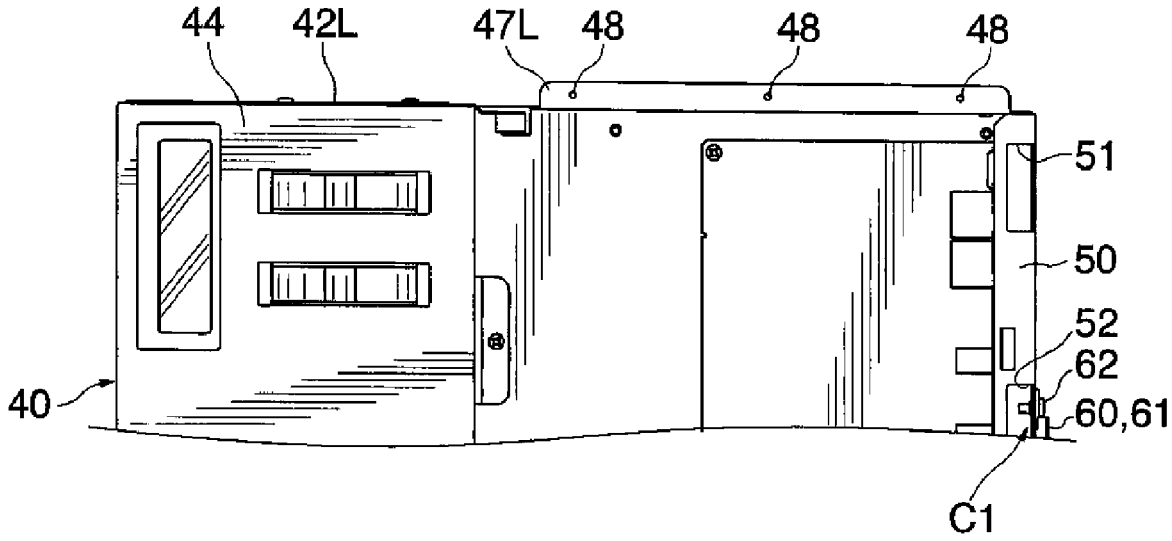
FIG. 4A is a plan view showing a left side portion of the electronic keyboard musical instrument in the state that the upper case and the arms have not been mounted to the lower case and the housing.
Figure 4B:
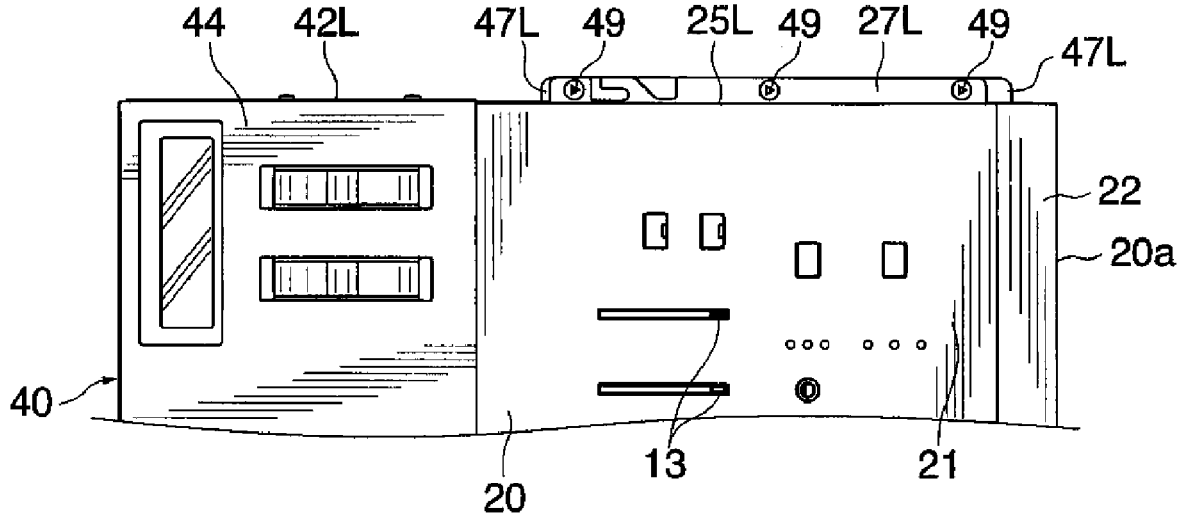
FIG. 4B is a plan view showing the left side portion of the musical instrument in the state that the upper case has been mounted to the lower case but the arms have not been mounted to the housing.
Figure 4C:
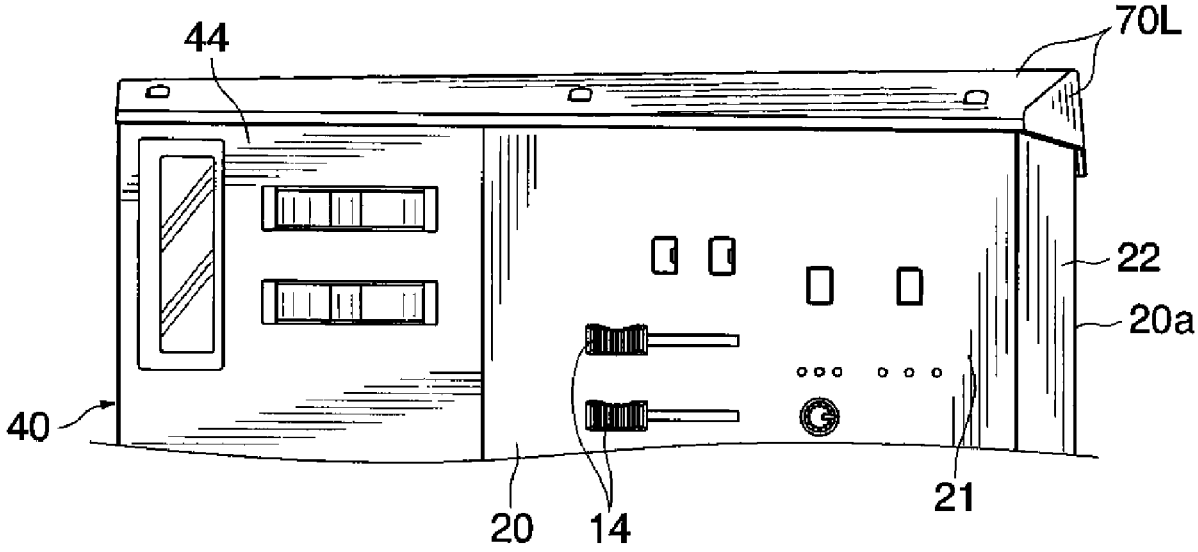
FIG. 4C is a plan view showing the left side portion of the musical instrument in a state that the upper case and the arms have been mounted to the lower case and the housing.

FIG. 4A shows in plan view a left side portion of the musical instrument, in which the upper case 20 has not been mounted to the lower case and the arms 70 have not been mounted to the housing 10. FIG. 4B shows in plan view the left side portion of the instrument, in which the upper case 20 has been mounted to the lower case 40 and the arms 70 have not been mounted to the housing 10. FIG. 4C shows in plan view the left side portion of the instrument, in which the upper case 20 and the arms 70 have been mounted to the lower case 40 and the housing 10.

A shown in FIGS. 1B and 2B, the keyboard unit KB is provided in the lower case 40, and side beds 44, 45 are fixedly disposed on the lower case 40 on the left and right sides of the keyboard unit KB. The lower case 40 has a right side surface 42R thereof formed with a plurality of threaded holes 46 used for mounting the arm 70R to the housing 10. These holes 46 are spaced apart from one another in the forward-to-backward direction of the instrument (see FIG. 2B). A plate-like lower flange 47R is extended from the right side surface 42R of the lower case 40 (see FIGS. 2A, 2B, 3A and 3B). Preferably, the lower flange 47R is made of metal and fixedly provided to the right side surface 42R of the lower case 40. In the case of the lower case 40 being made of metal, it is preferable that the lower flange 47R be formed integrally with the lower case 40.

As shown in FIGS. 4A and 4B, a lower flange 47L is extended from a left side surface 42L of the lower case 40. The left side surface 42L is formed symmetrical with and similar to the right side surface 42R, and the lower flange 47L is formed symmetrical with and similar to the lower flange 47R. Each of the lower flanges 47L, 47R is formed with a plurality of threaded holes 48 extending vertically therethrough (see FIG. 4A).

The upper case 20 includes left and right side members 25L, 25R thereof extending parallel to each other in the forward-to-rearward direction and in the vertical direction thereof (see FIGS. 2A, 2B, 3B, and 4B). As shown in FIGS. 2A, 2B and 3B, the right side member 25R is formed with a plurality of threaded holes 26 used for mounting the arm 70R to the housing 10, these holes 26 being spaced from one another in the forward-to-rearward direction of the instrument. Preferably, the right side member 25R is made of metal and fixedly provided to the upper plate 21 of the upper case 20. In the case of the upper plate 21 being made of metal, it is preferable that the right side member 25R be formed integrally with the upper plate 21.

A lower portion of the right side member 25R of the upper case 20 is bent rightward to form an upper flange 27R extending rightward. A lower portion of the left side member 25L is bent leftward to form an upper flange 27L extending leftward. The left side member 25L is formed symmetrical with and similar to the right side member 25R, and the upper flange 27L is formed symmetrical with and similar to the upper flange 27R. Each of the upper flanges 27L, 27R is formed with fastening holes 30 corresponding to the threaded holes 48 of the lower flange 47 (see FIGS. 2B and 3A).

When the upper case 20 has been mounted and fixed to the lower case 40, the upper flanges 27L, 27R are disposed in a facing relation with and contact with the lower flanges 47L, 47R (see FIGS. 2B and 3B). By inserting screws 49 into fastening holes 30 and then threadedly engaging the screws 49 with the threaded holes 48, the upper case 20 is fixed to the lower case 40 from above (see FIG. 4B). Since the screws 49 can be threadedly engaged in a state that the upper case 20 is turned right side up, the threaded engagement of the screws 49 can be carried out, while adjusting the horizontal position of the upper case 20 based on visual checking.

A display screen 12 and a number of operating element groups 11 are disposed on a surface of the upper plate 21 of the upper case 20 (see FIG. 2B), and a board, not shown, is disposed on an undersurface of the upper plate 21 of the upper case 20. The operating element groups 11 are disposed on the board and exposed to the surface of the upper plate 21 (see FIGS. 1A and 1B). Some of the operating element groups 11 include fader operating elements 14, which are mounted from the surface side of the upper plate 21 to fader mounting portions 13 disposed on the board (see FIGS. 4B and 4C).

Figure 5C:
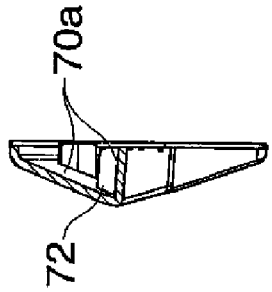
FIG. 5C is a section view taken along line A-A in FIG. 5A.
Figure 5A:
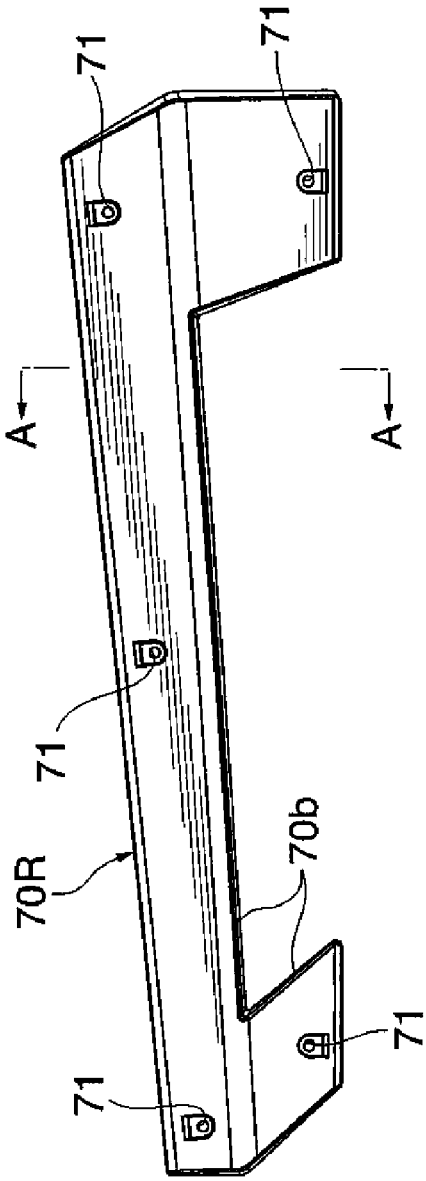
FIG. 5A is a right side view showing a surface side of the arm.
Figure 5B:
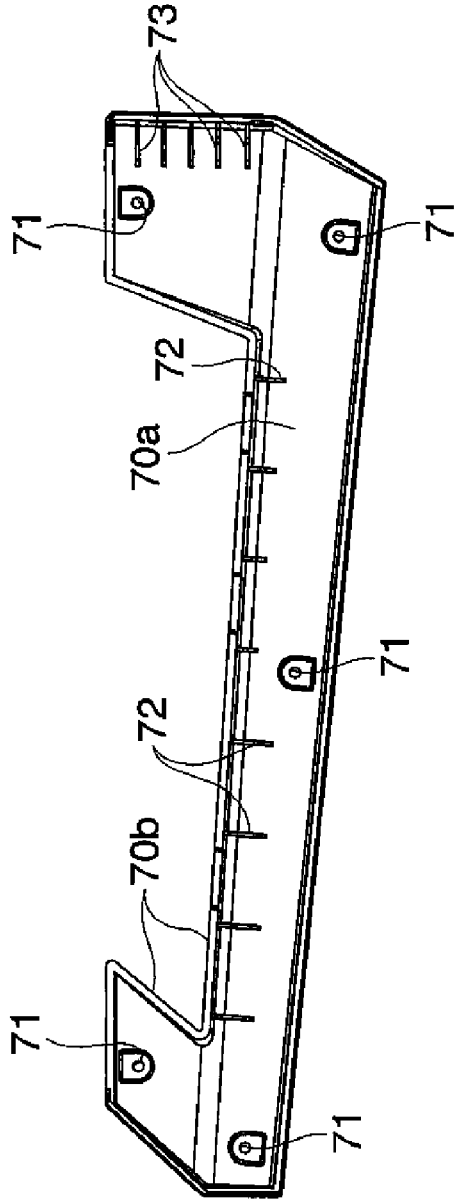
FIG. 5B is a left side view showing an undersurface side of the arm.

FIG. 5A shows in right side view a surface side of the arm 70R, FIG. 5B shows in left side view an undersurface side of the arm 70R, and FIG. 5C is a section view taken along line A-A in FIG. 5A. The arms 70R, 70L are configured symmetrical and similar to each other and formed separately from the housing 10.

The arm 70R is formed at its longitudinal central lower portion with a recessed portion 70*b* that forms, after the arm 70R has been attached to the housing 10, a grasped portion used by a user to grasp the musical instrument. The arm 70R is made of a resin and molded into one piece. The arm 70R is formed with a plurality of fastening holes 71 to correspond to the threaded holes 26 in the right side member 25R of the upper case 20 and the threaded holes 46 in the right side surface 42R of the lower case 40, which are shown in FIG. 3B, etc. (see FIGS. 5A and 5B).

As shown in FIG. 5C, the arm 70R includes an upper half thereof formed with recessed run-off portions 70*a* extending in the longitudinal direction. When the arm 70R is mounted to the housing 10, the upper and lower flanges 27R, 47R of the upper and lower cases 20, 40 are fitted into the run-off portions 70*a* without causing interference with each other. As shown in FIG. 5B, the arm 70R has a left side portion (on the rear side) thereof formed with a plurality of libs 72, 73 for ensuring sufficient rigidity.

Figure 6:
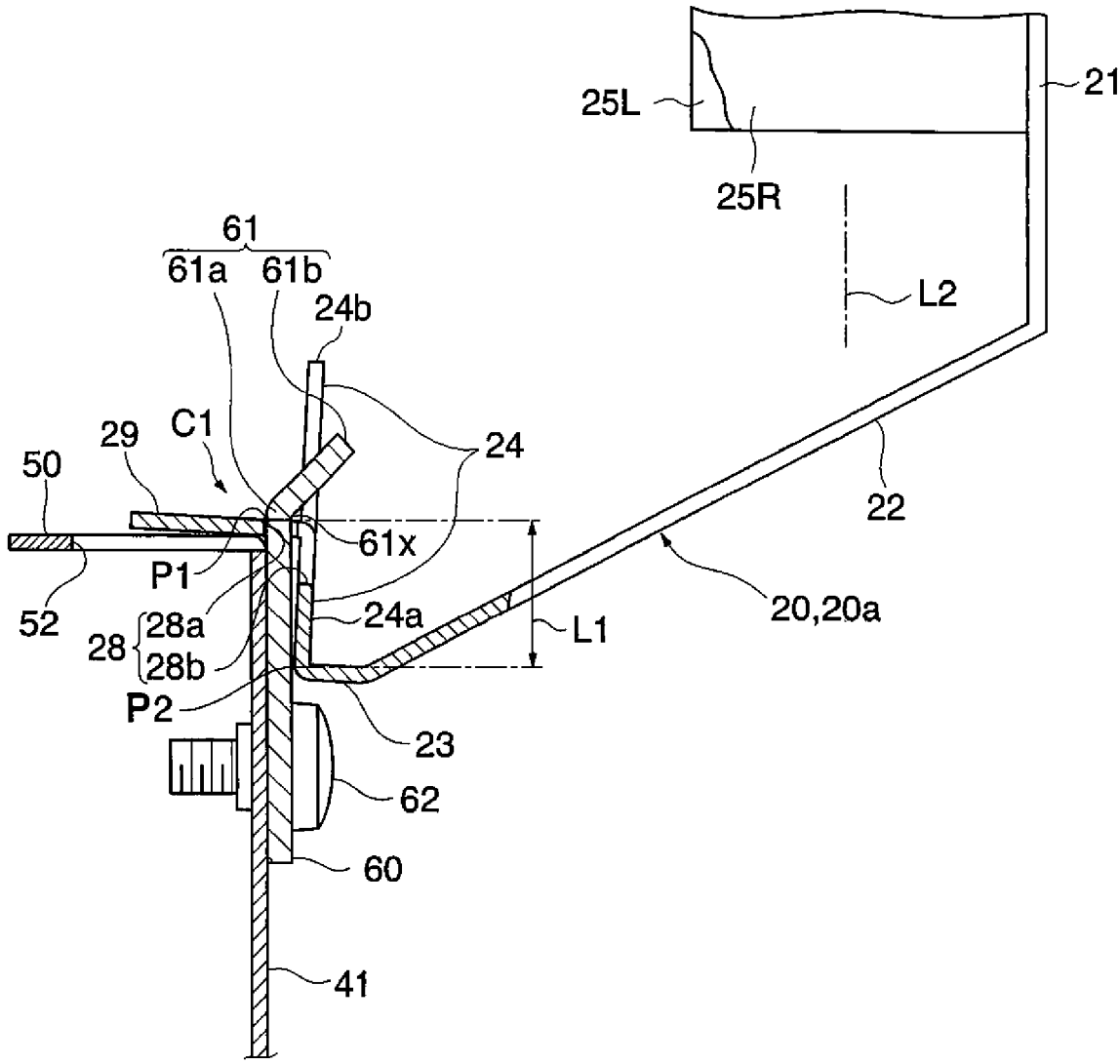
FIG. 6 is a vertical section view showing the construction of one pivot coupling part in a state that the upper case is open.

FIG. 6 shows in longitudinal section the construction of one of the pivot coupling parts C1 in a state that the upper case 20 is open (see FIG. 1B, etc.). In FIG. 6, there is shown a fully open state of the upper case 20 in which the upper case 20 is pivoted maximum in the opening direction around the pivot coupling parts C1, which will be referred to as the "open state". In FIG. 2B, there is shown a fully closed state of the upper case 20 in which the upper case 20 is pivoted maximum in the closing direction, which will be referred to as the "closed state".

Figure 7A:
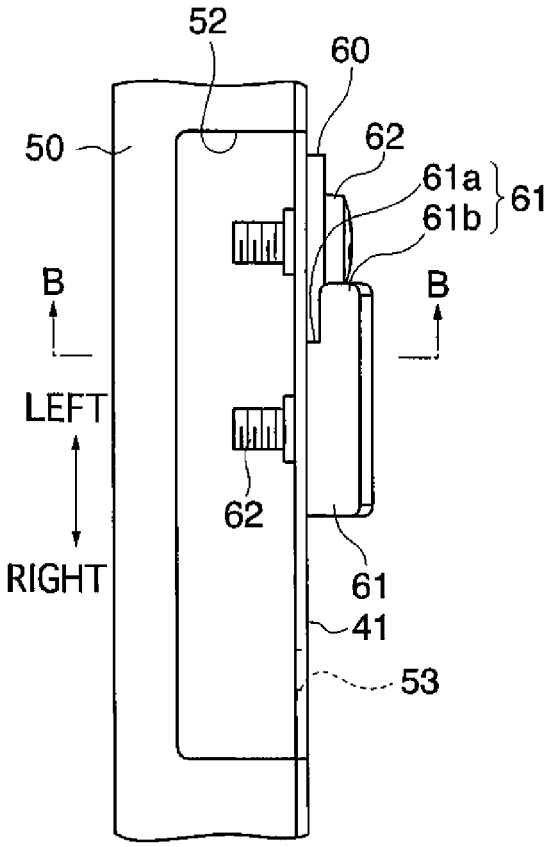
FIG. 7A is a plan view showing those portions of the pivot coupling part which are provided in the lower case.
Figure 7C:
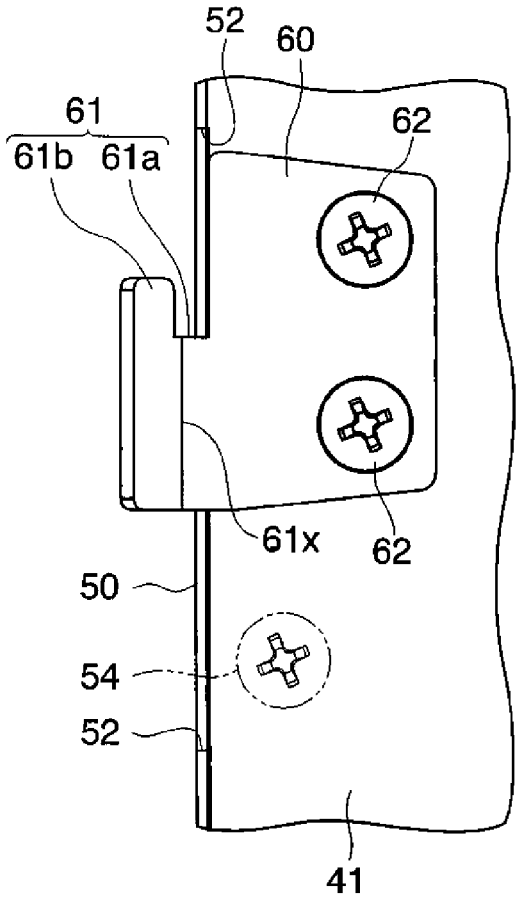
FIG. 7C is a rear view showing the portions of the pivot coupling part which are provided in the lower case.
Figure 7B:
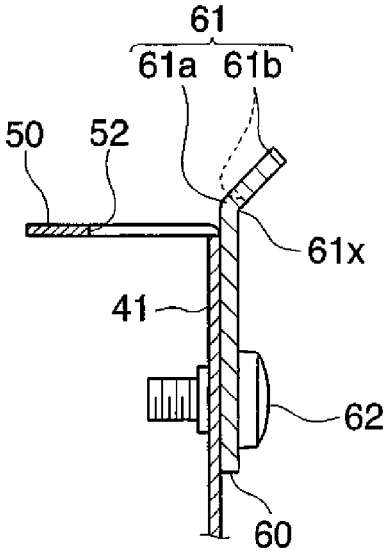
FIG. 7B is a section view taken along line B-B in FIG. 7A.

FIG. 7A shows in plan view those portions of one pivot coupling part C1 which are provided in the lower case 40, FIG. 7B is a section view taken along line B-B in FIG. 7A, and FIG. 7C shows in rear view the just-mentioned portions of the pivot coupling part C1 which are provided in the lower case 40. FIG. 6 corresponds to a section view taken along line B-B in FIG. 7A. The pivot coupling parts C1 are two in number and spaced from each other in the left-to-right direction of the instrument. Three or more pivot coupling parts can be provided. The two pivot coupling parts C1 are the same in construction from each other, but can be configured symmetrical to each other.

As shown in FIG. 6, each pivot coupling part C1 is comprised of an upper portion of the rear plate 41 of the lower case 40, a horizontal portion 50 of the lower case 40, a rear end portion 20*a* of the upper case 20, and a plate 60. The rear end portion 20*a* of the upper case 20 includes a first bent portion 22, a second bent portion 23, and a third bent portion 24. The rear end portion 20*a* is formed into one piece and bent into a hook shape as a whole. The first bent portion 22 is connected, on one hand, to the upper plate 21 of the upper case 20, and is connected, on the other hand, to the second bent portion 23, which is in turn connected to the third bent portion 24. As seen from lateral side, an obtuse angle is formed between the first bent portion 22 and the upper plate 21 on the inner side thereof (on the front side in an open state), and the second bent portion 23 extends nearly perpendicular to the upper plate 21. The third bent portion 24 extends at an angle of approximately several to ten degrees relative to the upper plate 21 and becomes closer to the upper plate 21 toward a tip end of the third bent portion 24.

As shown in FIGS. 4A, 6 and 7A to 7C, the plate-like horizontal portion 50 extends horizontally and forwardly from an upper end portion of the rear plate 41 of the lower case 40. The horizontal portion 50 of the lower case 40 can be formed integrally with or separately from the rear plate 41 so long as the horizontal portion 50 can be fixed to the rear plate 41. The horizontal portion 50 has portions each corresponding to one of the pivot coupling parts C1 and formed with rectangular holes 52 each of which is elongated in the key arrangement direction. In addition to the rectangular holes 52, rectangular holes 51 are formed in plural parts, including left and right end portions, of the horizontal portion 50 of the lower case 40 (see FIG. 4A).

Each plate 60 is mounted to a rear surface of the rear plate 41 using two screws 62 at a location corresponding to one of the rectangular holes 52 (refer to FIGS. 1B, 4A, 6 and 7A to 7C). As shown in FIG. 7B, the plate 60 has an upper portion thereof obliquely bent rearward (at an angle of approximately 45 degrees) to form an engagement protrusion 61. The engagement protrusion 61 includes a narrow-width portion 61*a* thereof including a bent part 61*x* and formed into a V-shape as seen in side views and includes a wide-width portion 61*b* obliquely extending from the narrow-width portion 61*a* toward a tip end of the engagement protrusion and formed straightly as seen in side view.

As shown in FIGS. 7A and 7C, the narrow-width portion 61*a* extends from a right half of the plate 60, and the wide-width portion 61*b* is formed to be elongated on the left side of the narrow-width portion 61*a* as viewed in the key arrangement direction. The plate 60 is preferably made of metal but only required to be capable of being fixed to the rear plate 41. The plate 60 can be formed integrally with the rear plate 41.

Figure 8B:
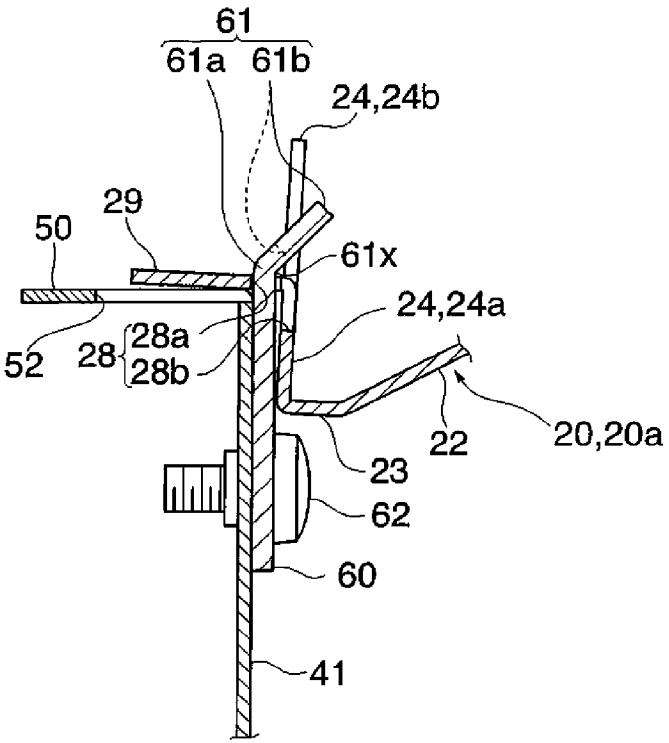
FIG. 8B is a section view taken along line C-C in FIG. 8A.
Figure 8A:
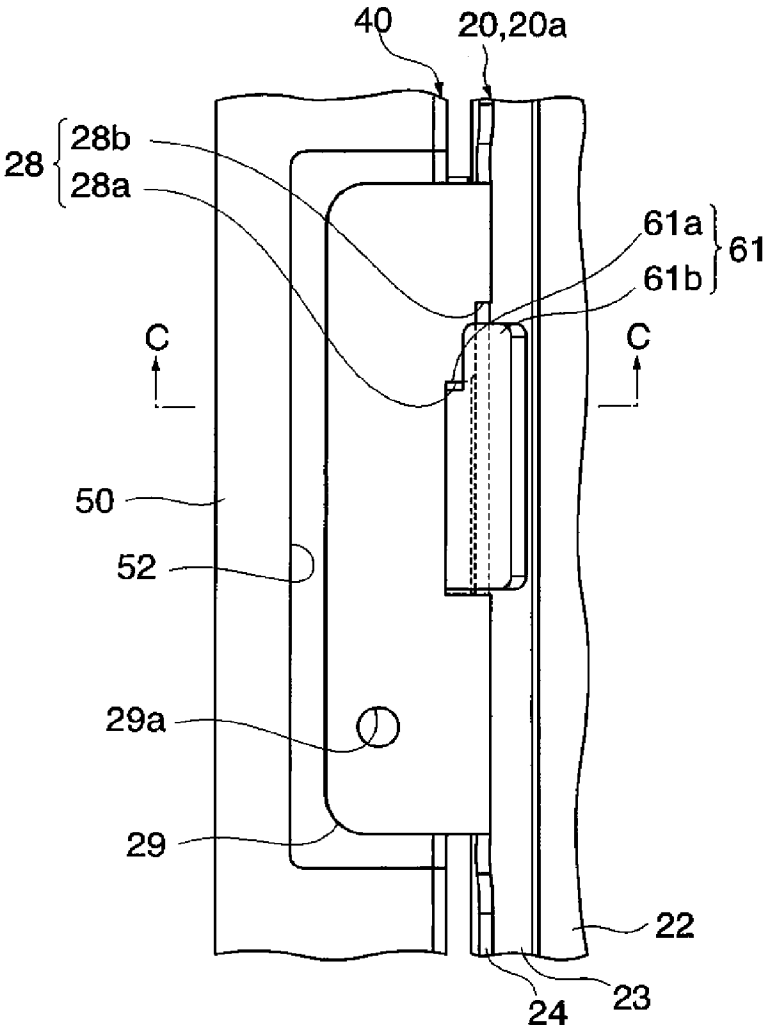
FIG. 8A is a plan view showing the pivot coupling part in a state that the upper case is open.
Figure 9B:
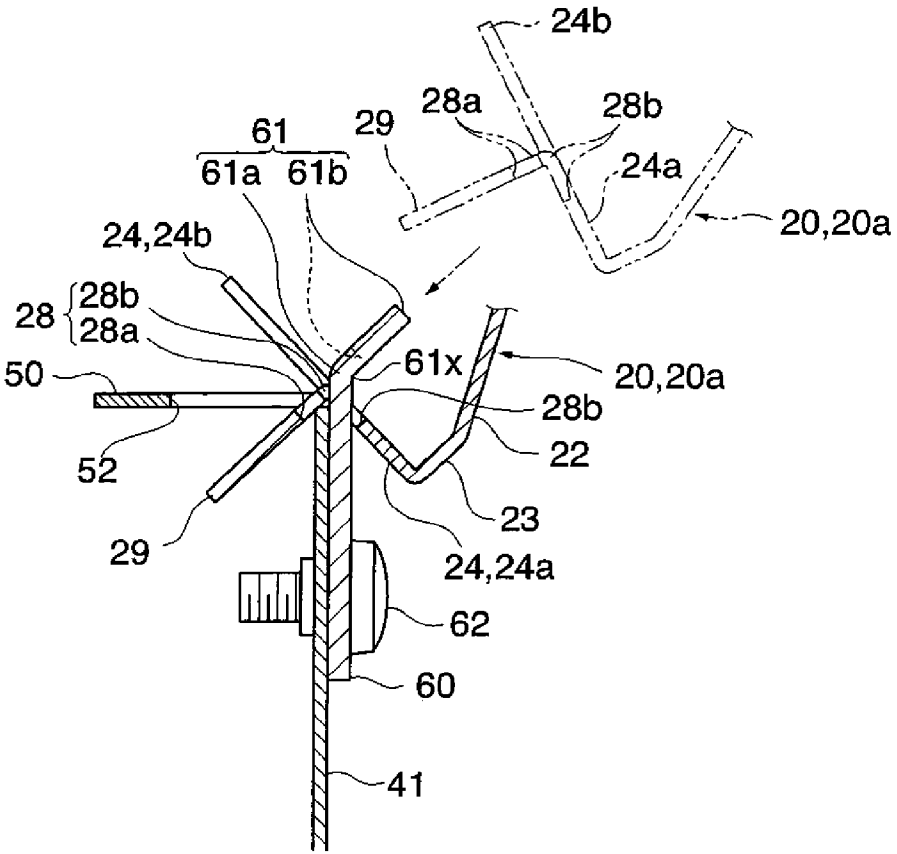
FIG. 9B is a section view taken along line D-D in FIG. 9A.
Figure 9A:
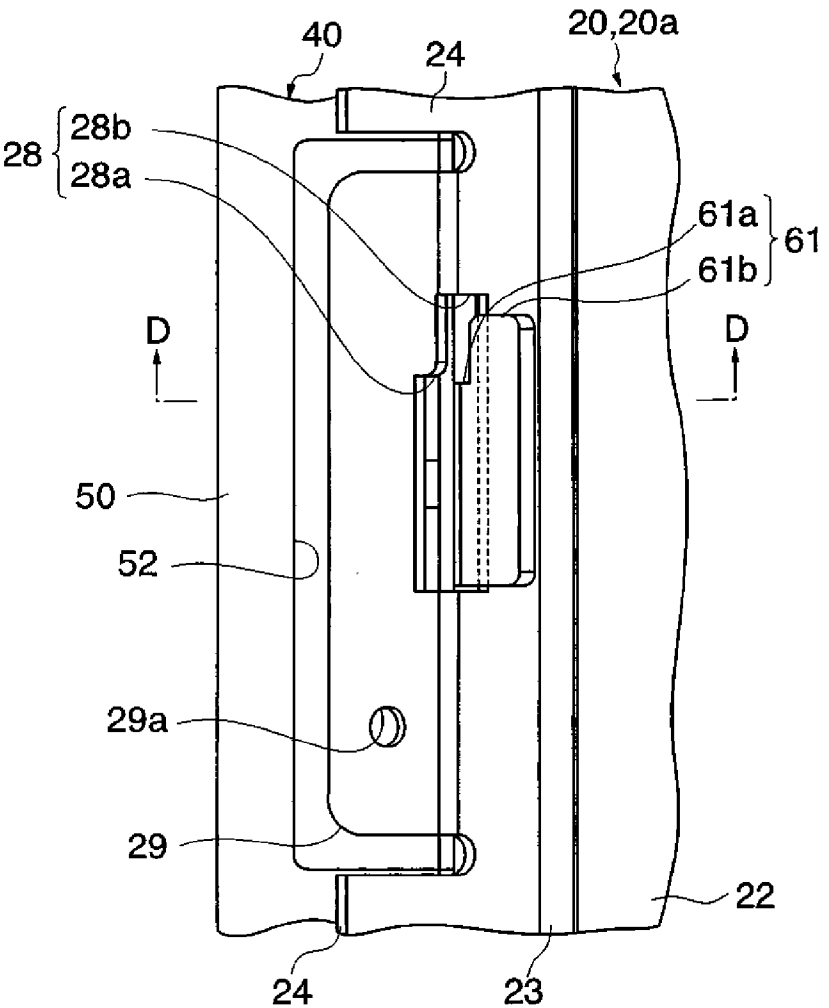
FIG. 9A is a plan view showing the pivot coupling part in a state that the upper case is started to be mounted or is being pivoted for open/close movement.
Figure 10B:
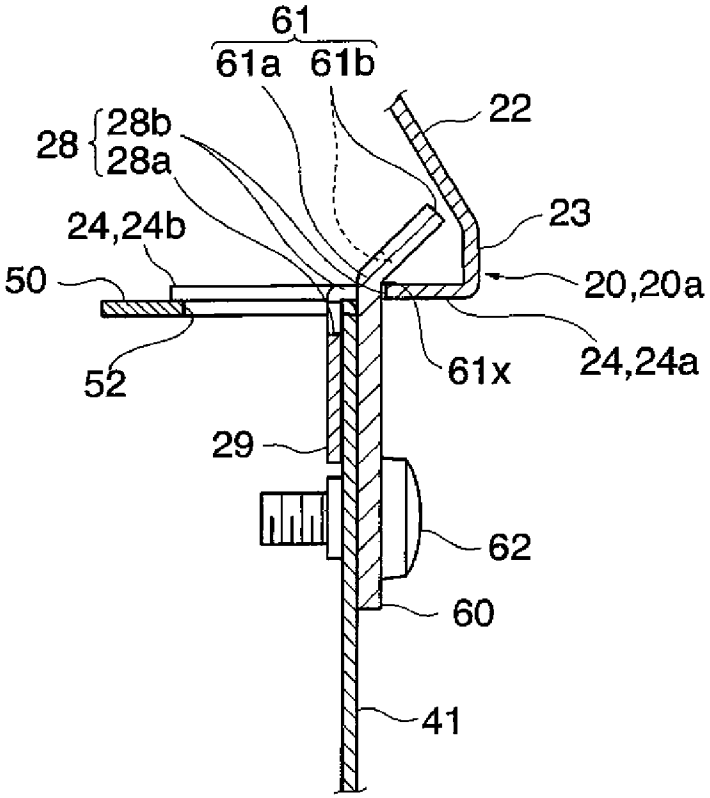
FIG. 10B is a section view taken along line E-E in FIG. 10A.
Figure 10A:
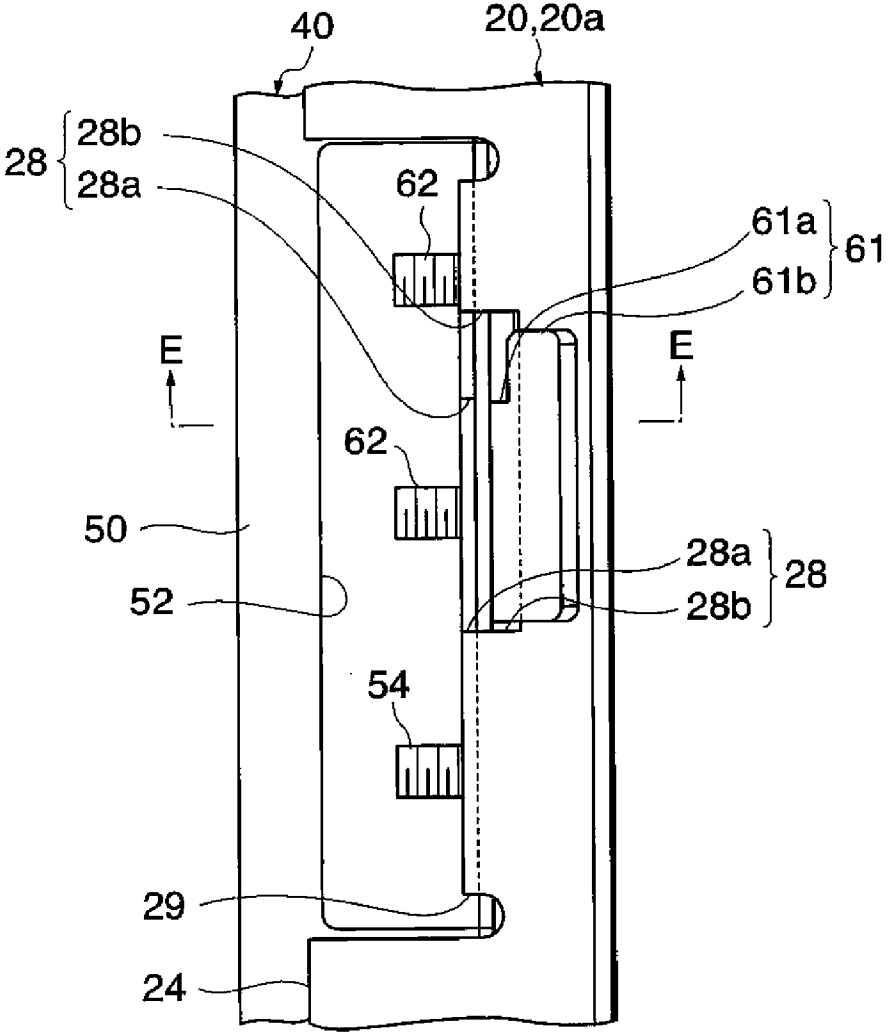
FIG. 10A is a plan view showing the pivot coupling part in a state that the upper case is closed.

FIGS. 8A, 9A and 10A are plan views of one pivot coupling part C1, and FIGS. 8B, 9B and 10B are section views respectively taken along line C-C in FIG. 8A, line D-D in FIG. 9A, and line E-E in FIG. 10A. FIGS. 8A and 8B show the upper case 20 in an open state and FIGS. 10A and 10B show the upper case 20 in a closed state. FIGS. 9A and 9B show the upper case 20 in a state in which the upper case is started to be mounted or a state in which the upper case is being pivoted for open/close movement (semi-open state). The upper case 20 is mounted and fixed to the lower case 40 in a state the upper case 20 is closed.

The third bent portion 24 of the upper case 20 is formed over the entire width of the upper case 20 in the key arrangement direction. The third bent portion 24 has bent pieces 29 thereof corresponding to the pivot coupling parts C1 and bent at right angles toward the side opposite from the upper plate 21 (see FIGS. 6, 8B, 9B and 10B). As shown in FIG. 9A, a planar shape of each bent piece 29 observed when the upper case 20 is in an open state corresponds to that of the rectangular hole 52. The extension length of the bent piece 29 and the length thereof as viewed in the key arrangement direction are slightly shorter than the lengths of the rectangular hole 52 as viewed in the forward-to-rearward direction and in the key arrangement direction.

Although an illustration is omitted, the third bent portion 24 has portions thereof corresponding to the rectangular holes 51 (see FIG. 4A) and each formed with a bent piece, which is bent similarly to the bent piece 29.

As shown in FIGS. 6 and 8A to 10B, each of engagement holes 28 is formed from a root part 24*a* of the third bent portion 24 to the root of the bent piece 29 of the third bent portion 24, the root part 24*a* being located at a location closer to the second bent portion 23 than to the bent piece 29. Specifically, the third bent portion 24 is formed at the root part 24*a* with a wide-width counterpart 28*b* and formed at a root of the bent piece 29 with a narrow-width counterpart 28*a*. The wide- and narrow-width counterparts 28*b*, 28*a* are continuously formed to form one engagement hole 28.

The wide-width counterpart 28*b* is longer than the narrow-width counterpart 28*a* toward leftward as viewed in the key arrangement direction. Specifically, the wide-width counterpart 28*b* is slightly longer than the wide-width portion 61*b* of the engagement protrusion 61 in the key arrangement direction so as to permit the wide-width portion 61*b* to be inserted into the wide-width counterpart 28*b*. The narrow-width counterpart 28*a* is sufficiently shorter than the wide-width counterpart 28*b* and the wide-width portion 61*b* so as not to permit the wide-width portion 61*b* to be inserted thereinto, but is slightly longer than the narrow-width portion 61*a* to permit the narrow-width portion 61*a* to be inserted thereinto.

Each bent piece 29 is formed with a threaded hole 29*a* (see FIGS. 8A and 9A). On the other hand, the rear plate 41 of the lower case 40 is formed with fastening holes 53 corresponding to the threaded holes 29*a* (see FIG. 7A). When the upper case 20 is closed, the bent pieces 29 are made in a facing relation and contact with a front surface of the rear plate 41 (see FIGS. 10A and 10B). In this state, the bent pieces 29 are fixed to the rear plate 41 by screws 54 passing through the fastening holes 53 and the threaded holes 29*a* (see FIGS. 1B, 7C and 10A). Similarly, the above described bent pieces, not shown, and the rear plate 41 are formed with fastening holes and threaded holes corresponding to the rectangular holes 51 of the third bent portion 24 (see FIG. 4A). The bent pieces and the rear plate 41 are fixed together by screws 15 (refer to FIG. 1B). Using the two screws 54 and plural screws 15, the upper case 20 which is in a closed state is fixed to the lower case 40 from the rear side.

Upon mounting the upper case 20 to the lower case 40, the above described component parts such as the board, not shown, are mounted in advance to the upper case 20, and component parts are disposed on the lower case 40. The upper case 20 is mounted to the lower case 40 in a manner described below.

First, as shown in FIG. 9B, surfaces of the left and right two bent pieces 29 of the upper case 20 and the root part 24*a* of the third bent portion 24 of the upper case 20 on the acute angle side of these are made close to the engagement protrusions 61 of the plates 60 along the direction in which the protrusions 61 project. The wide-width portions 61*b* of the engagement protrusions 61 are inserted into and engaged with the wide-width counterparts 28*b* of the engagement holes 28 of the two bent pieces 29. At that time, the surfaces of the bent pieces 29 of the upper case 20 and the root part 24*a* of the third bent portion 24 of the upper case 20 on the acute angle side thereof cooperate to form a V-shape as seen from lateral side and achieve an engagement guide function.

The upper case 20 is moved until the wide-width portions are inserted into the wide-width counterparts 28*b* and the third bent portion 24 is made in contact with the rear plate 41, whereby the narrow-width portions 61*a* are brought in engagement with the engagement holes 28. By moving the upper case 20, having its posture and being at a pivotal angle shown in FIG. 9B, toward and away from the wide-width portions 61*b* of the engagement protrusions 61 along the direction in which the protrusions 61 project, the engagement protrusions 61 of the plates 60 can freely be inserted into and engaged with the engagement holes 28 and removed from the engagement holes 28 formed in the upper case 20.

There is an allowable range of approximately 20 degrees for the pivot angle of the upper case 20 at which the above described insertion and engagement/disengagement can freely be made. As seen in right side view, the allowable pivot angle range is approximately 20 degrees measured clockwise in FIG. 9B from an angular position at which the bent pieces 29 are in parallel to the wide-width portions 61*b*. Hereinafter, such an allowable pivot angle range will be referred to as the "mountable/dismountable angle range". Therefore, at the time of assembly and maintenance of the product, the upper case 20 is mounted to and dismounted from the lower case 40 in a condition that the upper case 20 has a posture corresponding to the mountable/dismountable angle range.

In a state that the engagement protrusions 61 are inserted into and engaged with the engagement holes 28 (FIGS. 9A and 9B), the upper case 20 is pivoted relative to the lower case 40 in the opening and closing direction, with the narrow-width portions 61*a* aligned with the narrow-width counterparts 28*a* in position in the key arrangement direction. Specifically, the pivot operation is carried out, with the right ends of the engagement protrusions 61 made close to or made in contact with the right ends of the engagement holes 28. Since the pivot coupling parts C1 are constituted by the engagement protrusions 61 being inserted into and engaged with the engagement holes 28, the upper case 20 can be pivoted without being detached from the lower case 40. In addition, the opening and closing operation can be performed with a light force, with the tip end of the upper case 20 or the like grasped by a user or an operator.

To close the upper case 20, the upper case 20 is pivoted counterclockwise in FIG. 9B. As shown in FIGS. 10A and 10B, when the upper case 20 is pivoted counterclockwise, the tip end side half 24*b* of the third bent portion 24 opposite from the root part 24*a* with respect to the bent piece 29 is made in a facing relation and contact with the upper surface of the horizontal portion 50 of the lower case 40, and the bent piece 29 is made in a facing relation and contact with the front surface of the rear plate 41. Furthermore, the upper flanges 27L, 27R are made in a facing relation and contact with the lower flanges 47L, 47R (see FIGS. 2B and 3B).

In this closed state, as shown in FIGS. 10A and 10B, the narrow-width portions 61*a* of the engagement protrusions 61 are engaged with the wide-width counterparts 28*b* of the engagement holes 28. In addition, the bent pieces 29 are in contact with the front surface of the rear plate 41, and the edge portions of the wide-width counterparts 28*b* on the root part 24*a* side are in contact with the bent parts 61*x* of the rear surfaces of the engagement protrusions 61. As a result, even if it is attempted to displace the upper case 20, with the present posture of the upper case 20 kept unchanged, in the direction in which the wide-width portions 61*b* project, the upper case 20 cannot be displaced and therefore the closed state of the upper case 20 is stably maintained.

Specifically, due to the contact between the bent pieces 29 and the rear plate 41, the upper case 20 cannot be displaced rearward. Since the end portion of the root part 24*a* on the wide-width counterpart 28*b* side is in contact with the bent parts 61*x* of the plates 60 and those portions of the engagement protrusions 61 of the plates 60 which are located above the bent parts 61*x* are obliquely bent rearward, the upper case 20 cannot be displaced forward and straightly upward. Since the third bent portion 24 of the upper case 20 is in contact with the upper end of the rear plate 41 of the lower case 40, the upper case 20 cannot be displaced downward. As a result, the rear end portion 20*a* of the upper case 20 is locked at the pivot coupling parts C1 so as not to be displaced in the forward-to-backward direction and in the vertical direction. Thus, the upper case 20 never be unintentionally detached from the lower case 40 at the pivot coupling parts C1. Since the upper case 20 is temporarily fixed in this manner, subsequent fastening operations are easy to carry out.

In the closed state, screws 54, 15 are threadedly engaged with the rear plate 41 from the rear side (see FIGS. 1B and 7C). Then, the lower and upper flanges 47, 27 are threadedly fixed together by screws 49 from above (see FIG. 4B). As a result, the upper case 20 is fixed to the lower case 40 from rear and from above. Furthermore, an operation of mounting the fader operating elements 14 to the fader mounting portion 13 and other operations are performed (see FIGS. 4B and 4C).

After the upper case 20 is fixed to the lower case 40 to complete the housing 10, the arms 70L, 70R are mounted to the housing 10. First, the arms 70L, 70R held by a user or an operator are moved toward the housing 10 from the left and right sides, and are positioned such that their run-off portions 70*a* cover the upper and lower flanges 27, 47 to be invisible. Then, screws 74 are inserted into fastening holes 71 from the left and right sides (see FIGS. 5A and 5B) and then threaded into the threaded holes 26 of the upper and lower cases 20, 40 (see FIGS. 2B and 3B), whereby the arms 70L, 70R are fixed to the housing 10 (see FIGS. 3D and 4C).

After completion of the fabrication of the product, the upper case 20 is sometimes required to be dismounted from the lower case 40 for performing maintenance or the like. In that case, the arms 70 are detached and then the screws 54,15 are detached from the housing 10 (see FIGS. 1B and 7C). Then, the upper case 20 is pivoted in the opening direction until the root part 24*a* of the third bent portion 24 is in contact at contact portions P2 with the plates 60, as shown in FIG. 6.

At that time, the narrow-width counterparts 28*a* of the engagement holes 28 are engaged with the narrow-width portions 61*a* of the engagement protrusions 61, and edge portions of the bent pieces 29 (end portions of the bent pieces 29 on the narrow-width portion 61*a* side) are in contact at contact portions P1 with the front surfaces of the narrow-width portions 61*a*. In this state, the upper case 20 is opened, in which the third bent portion 24 and the upper plate 21 are slightly inclined rearward with respect to the vertical direction.

In the open state of the upper case 20 where the narrow-width counterparts 28*a* are engaged with the narrow-width portions 61*a*, even if it is attempted to move the upper case 20 upward, the narrow-width counterparts 28*a* interfere with lower ends of the wide-width portions 61*b*, and therefore, the upper case 20 cannot further be moved. The upper case 20 cannot be displaced rearward due to the contact between the bent pieces 29 and the narrow-width portions 61*a* at the contact points P1 and cannot be displaced forward due to the contact between the third bent portion 24 and the plates 60 at the contact portions P2. Since the third bent portion 24 is in contact with the upper end of the rear plate 41, the upper case 20 cannot be displaced downward. As a result, the rear end portion 20*a* of the upper case 20 is substantially locked at the pivot coupling parts C1 so as not to be capable of being displaced in the forward-to-backward direction and in the vertical direction. Thus, the upper case never be unintentionally dismounted from the lower case 40 at the pivot coupling parts C1.

When the upper case 20 is in the open state, the center of gravity of the upper case 20 is positioned on an extension line of vertical line L2 shown in FIG. 6, and is thus positioned rearward of the plate 60 (between the third bent portion 24 and the upper plate 21) as viewed in the forward-to-backward direction. Accordingly, due to the own weight of the upper case 20, a clockwise torque is applied to the pivot coupling parts C1. At the contact portions P1, P2, reaction forces matching this torque are generated.

As a result, the upper case 20 is stably maintained in posture, even if an operator's hand is detached from the upper case 20 which is the open state. Hence, in the open state, the upper case 20 never be unintentionally pivoted in the closing direction. At the time of maintenance or the like, component parts disposed in the lower case 40 can safely be checked and replaced or the like, with the upper case 20 remained open. To permit the upper case 20 to be stably supported in the open state, it is preferable that the vertical distance between the contact portions P1, P2 should be made long.

In this embodiment, when the upper case 20 is in an open state, the root part 24*a* of the third bent portion 24 in the rear end portion 20*a* of the upper case 20 is in contact with the plates 60 at the contact portions P2 (see FIG. 6). In other words, the root part 24*a* is indirectly in contact with the rear plate 41 of the lower case 40 via the plates 60. On the other hand, in the case of the plates 60 being formed integrally with the rear plate 41 of the lower case 40, the root part 24*a* in the upper case 20 is directly in contact with the rear plate 41.

Also in product assembly processes, component parts can be mounted to the lower case 40 in a state that the upper case 20 is engaged with the pivot coupling parts C1 to thereby maintain the upper case 20 in an open state, not in a state that the upper case 20 is completely spaced from the lower case 40. In this manner, there is a freedom in formulating working processes.

The angle at which the engagement protrusions 61 of the plates 60 are bent rearward, i.e., the angle at which the wide-width portions 61*b* are projectedly formed relative to the vertical direction, is equal to about 45 degrees, but can be set to an angle falling within a range from zero degree to 90 degrees.

The just-mentioned angle can be set arbitrarily so long as the wide-width portions 61*b* can be inserted into and removed from the engagement holes 28 only when the upper case is moved, while being kept retained at a predetermined pivot angle, relative to the engagement protrusions 61 in a direction parallel to the direction in which the wide-width portions 61*b* are projectedly formed. The predetermined pivot angle falls within the above described mountable/dismountable angle range. In particular, when the upper case 20 is in a nearly closed state (see FIGS. 10A and 10B), a function of preventing the engagement between the engagement protrusions 61 and the engagement holes 28 from being released is achieved by the contact between the wide-width counterparts 28 of the engagement holes 28 and the bent parts 61*x* of the engagement protrusions 61 and the contact between the bent pieces 29 and the rear plate 41. By taking the above into consideration, the design is made so as to ensure the mountable/dismountable angle range.

According to this embodiment, the wide-width portions 61*b* and the wide-width counterparts 28*b* can be relatively inserted into and removed from each other only when the upper case 20 having a posture corresponding to the mountable/dismountable angle range is moved in the direction in which the wide-width portions 60*b* are projectedly formed (see FIGS. 9A and 9B). Thus, the upper case 20 can easily be mounted to and dismounted from the lower case 40 only when the upper case 20 is in a semi-open state, making it possible to improve safety and working efficiency at the time of assembly and maintenance.

In particular, when the upper case 20 is in an open state (see FIGS. 8A and 8B), the wide-width positions 61*b* and the engagement holes 28 are prevented from being relatively inserted into and removed from each other in the direction in which wide-width portions 61*b* are projectedly formed by the engagement between the wide-width portions 61*b* and the narrow-width counterparts 28*a*. Thus, it is possible to prevent the upper case 20 from being unintentionally detached from the lower case 40 when the upper case 20 is in an open state.

When the upper case 20 is in a closed state (refer to FIGS. 10A and 10B), due to the engagement between the bent pieces 29 of the upper case 20 and the front surface of the rear plate 41 of the lower case 40 and the engagement between the wide-width counterparts 28*b* in the upper case 20 and the bent parts 61*x* of the plates 60, the engagement holes 28 and the wide-width portions 61*b* are prevented from being relatively inserted into and removed from each other in the direction in which the wide-width portions 61*b* are projectedly formed. Thus, it is possible to prevent the upper case 20 which is in a closed state from being unintentionally detached from the lower case 40.

Furthermore, when the upper case 20 is in an open state, since the open state of the upper case 20 is stably maintained by the contact and engagement at the contact portions P1, P2 (refer to FIG. 6), the workability and safety can be improved.

According to this embodiment, moreover, the lower flange 47 of the lower case 40 and the upper flange 27 of the upper case 20 are fixed together by screws 49 from above (see FIG. 4B) and the arms 70 are fixed to the housing 10 from the left and right sides so as to cover the screws 49 to be invisible. Thus, the upper case 20 can be fixed to the lower case 40 in a state that the upper and lower cases are turned right side up. In addition, the screws 49 can be made invisible by the arms 70 to provide a natural look, thereby improving the external appearance. In particular, since the run-off portions 70*a* provided in the arms 70 cover the entirety of the upper and lower flanges 27, 47 to be invisible, the external appearance can further be improved. As compared to a construction in which the upper and lower cases are fixed together by only hinges, this embodiment can ensure easy electrical conduction.

The lower and upper flanges 47, 27 (see FIG. 2B) are only required to face each other to be capable of being fastened and fixed to each other when the upper case 20 is in a closed state. Thus, it is unnecessary to form them into a plate shape such as a flange.

The screws 49 (see FIG. 4B) are disposed straightly in the vertical direction, but may be somewhat inclined as long as they are threaded from above.

From the viewpoint of merely improving the external appearance by making the screws 49 invisible, the arms 70 are only required to be constructed and disposed so as to cover at least the screws 49 to be invisible.

In the embodiment, the arms 70 are fastened to both the left and right side members 25L, 25R of the upper case 20 and the left and right side surfaces 42L, 42R of the lower case 40, but can be fastened and fixed to either one of the upper and lower cases 20, 40.

The arms 70 can be made of a material other than resin, such as for example, wood. In that case, recessed portions corresponding to the run-off portions 70*a* (see FIGS. 5A and 5B) can be bored by counter boring or the like.

Figure 11:
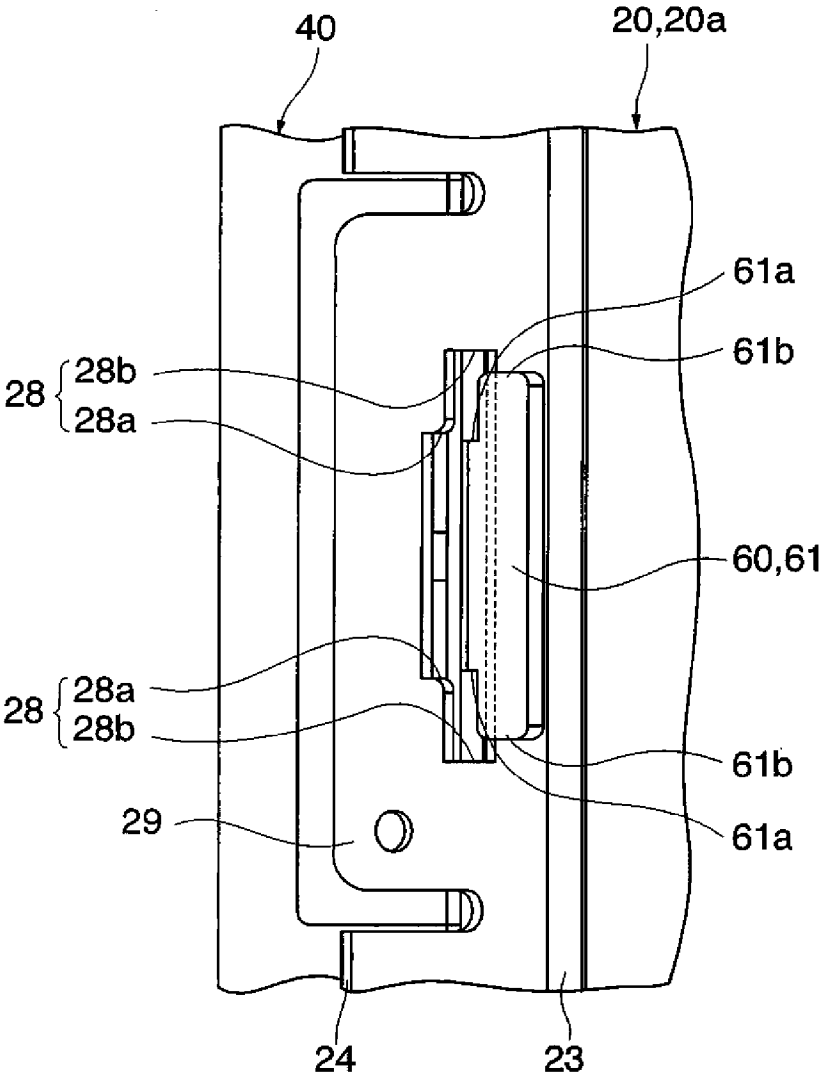
FIG. 11 is a plan view showing the pivot coupling part according to a modification that includes a plate and an engagement hole which are different in shape from those of the embodiment.

In the above described embodiment, the wide-width portions 61*b* of the engagement protrusions 61 of the plates 60 are made much elongated than the narrow-width portions 61*a* toward leftward alone, but this is not limitative. As shown in FIG. 11, the wide-width portions can be elongated toward leftward and rightward.

FIG. 11 shows in plan view a pivot coupling part C1 according to a modification in which the plate 60 and the engagement holes 28 are changed in shape. As shown in FIG. 11 corresponding to FIG. 10A, the wide-width portion 61*b* is much elongated toward the left and right sides than the narrow-width portion 61*a*, and the engagement protrusion 61 is formed into a T-shape as a whole. Accordingly, in the engagement hole 28 of the rear end portion 20*a* of the upper case 20, the wide-width counterpart 28*b* is much elongated toward the left and right sides than the narrow-width counterpart 28*a*. This construction achieves advantages which are the same as or similar to those attained by the above described embodiment.

Figure 12A:
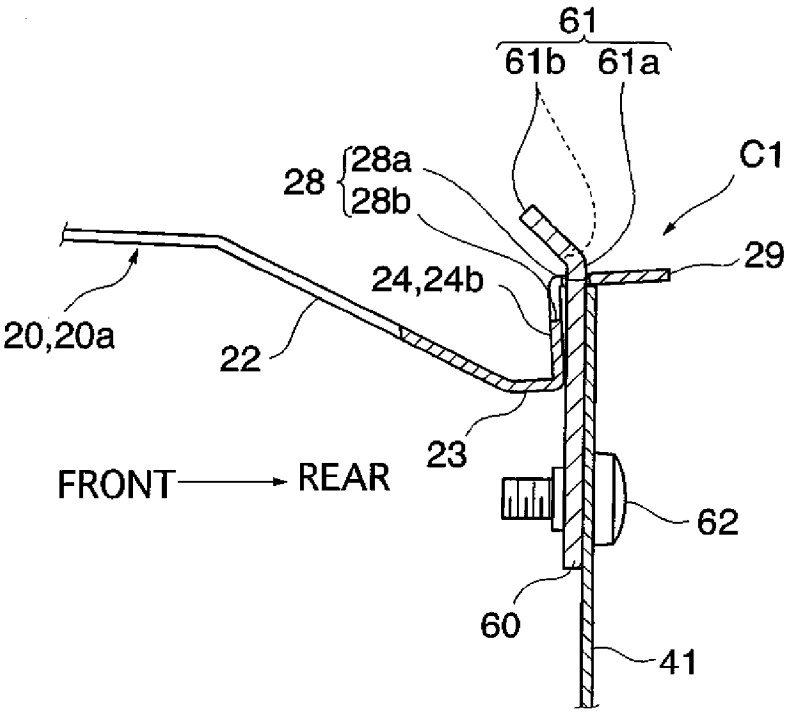
FIG. 12A is a view showing the upper case of the modification in a state that the upper case is closed.
Figure 12C:
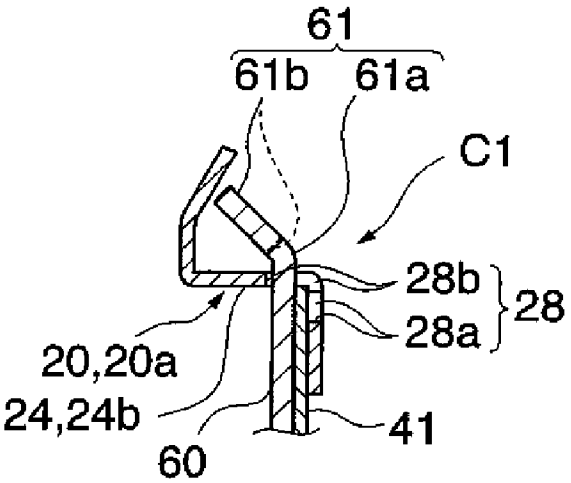
FIG. 12C is a view showing the upper case in an open state.
Figure 12B:
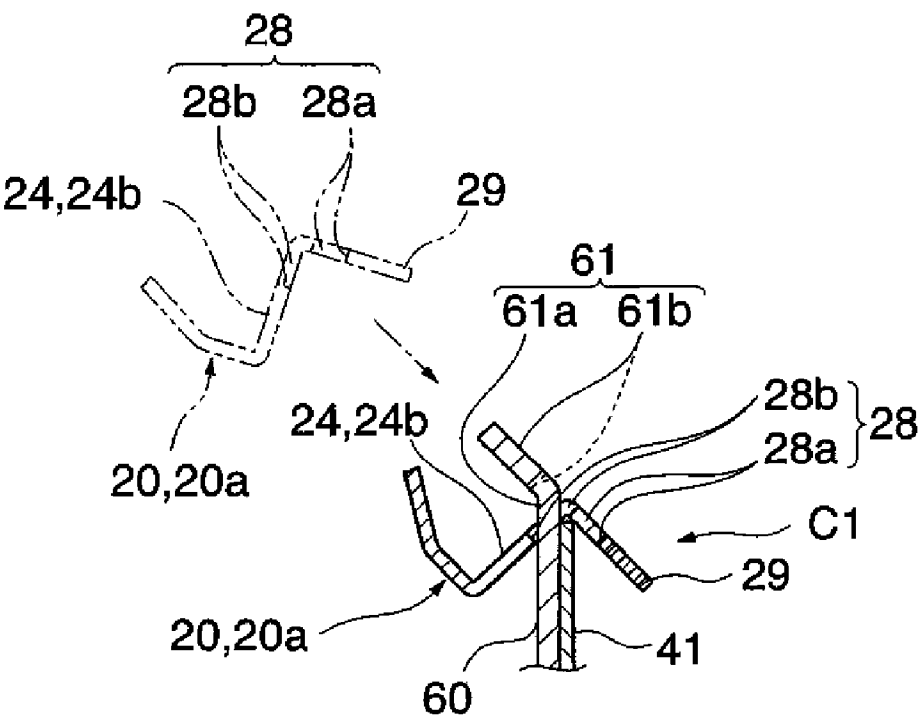
FIG. 12B is a view showing the upper case in a state that the upper case is being pivoted.

The engagement protrusions 61 of the plates 60 can be inclined not only rearward but also forward as shown in FIGS. 12A to 12C.

FIGS. 12A to 12C are views showing a modification of the pivot coupling part C1. FIGS. 12A to 12C corresponding to FIGS. 10B, 9B and 8B show a closed state of the upper case 20, a state where the upper case 20 is being pivoted, and an open state thereof. As shown in FIGS. 12A to 12C, the wide-width portion 61*b* of the engagement protrusion 61 is obliquely inclined forward. The plate 60 fixed to a front surface of the rear plate 41 of the lower case 40 can be fixed to a rear surface of the rear plate 41, and can be formed integrally with the rear plate 41. Except for the direction of inclination, the plate 60 is the same in construction as that of the above described embodiment.

The third bent portion 24 of the rear end portion 20*a* of the upper case 20 includes the root part 24*a* but does not include a part corresponding to the tip end side half 24*b*. In other respects, the third bent portion 24 is the same in construction as that of the above described embodiment.

According to the construction of this modification, when the upper case is being opened or closed, the wide-width portion 61*b* and the wide-width counterpart 28*b* can be relatively inserted into and removed from each other. Thus, the mountable/dismountable angle range is ensured (see FIG. 12B).

When the upper case 20 is in a closed state (FIG. 12A) or in an open state (see FIG. 12C), as with the case shown in FIGS. 10A and 10B and in FIGS. 8A and 8B, the rear end portion 20*a* of the upper case 20 is locked at the pivot coupling parts C1 so as not to be capable of being displaced in the forward-to-backward direction and in the vertical direction. Thus, at the pivot coupling parts C1, the upper case 20 never be unintentionally detached from the lower case 40.

However, when the upper case is in an open state (FIG. 12C), the above construction cannot prevent a pivotal motion in the closing direction. In order to stably maintain an open state of the upper case 20, it is necessary, such as for example, to provide a support member adapted to be engaged with between the lower case 40 and the front end of the upper case 20, or to provide some other measure.

According to the modification shown in FIGS. 12A to 12C, advantages attained by the construction shown in FIGS. 1A to 10B can be attained, except for the advantage of stably maintain an open state of the upper case 20 without requiring support by an operator's hand.

In the above described embodiment and the modification, the engagement protrusions 61 are provided in the lower case 40 and the engagement holes 28 are provided in the upper case 20. If it is unnecessary to ensure a satisfactory appearance, the engagement protrusions can be provided in the upper case 20 and the engagement holes can be provided in the lower case 40.

Either one or both of the keyboard unit KB and the side beds 44, 45 can be provided in the upper case 20 not in the lower case 40.

From the viewpoint of merely permitting the upper case 20 to be fixed to the lower case 40, with the upper and lower cases turned right side up, and permitting the screws 49 to be made invisible to provide a natural look to improve the external appearance, the upper case 20 is not required to be pivotally engaged with the lower case 40. For example, the upper case can be made to be completely separated from the lower case and can be superimposed on and fixed to the lower case from above. Alternatively, instead of using the pivot coupling parts C1, pivot mechanisms using pivot pins adapted for insertion and removal or some other construction can be adopted. There can also be used a construction where the upper case 20 is always coupled to the lower case 40 for pivotal motion by hinges or the like.

What is claimed is:

1. A housing structure of an electronic keyboard musical instrument having a housing comprised of lower and upper cases which are separate from each other, the upper case being adapted to be pivoted relative to the lower case between open and closed states and the housing being completed by fixing the upper case to the lower case with a keyboard open to above when the upper case is in the closed state and with a backward region of the keyboard open to above when the upper case is in the open state, comprising:

at least one protrusion fixedly formed in one of rear end portions of the upper and lower cases; and at least one engagement hole formed in the other of the rear end portions of the upper and lower cases, wherein the upper and lower cases are adapted to be pivoted relative to each other in an opening and closing direction around an engagement portion between the engagement hole and the protrusion inserted into and engaged with the engagement hole, wherein the protrusion and the engagement hole are adapted to be relatively inserted into and removed from each other in a radial direction of the pivotal movement to thereby allow the upper case to be attached to or detached from the lower case, only when the upper case is at a predetermined pivotal angle in a pivotal movement in the opening and closing direction, wherein the protrusion includes a narrow-width portion and a wide-width portion, the wide-width portion being arranged on a side close to a tip end of the protrusion with respect to the narrow-width portion and having a length longer than that of the narrow-width portion as viewed in a key arrangement direction, the engagement hole includes a wide-width counterpart having a width permitting the wide-width portion of the protrusion to be inserted thereinto and a narrow-width counterpart formed adjacent to the wide-width counter part and having a width not permitting the wide-width portion to be inserted thereinto but permitting the narrow-width portion to be inserted thereinto, the wide-width portion is adapted to be insertable into and removable from the wide-width counterpart when the upper case having a posture corresponding to the predetermined pivotal angle and the lower case are relatively moved in a direction in which the protrusion is projectedly formed, and the protrusion and the engagement hole are prevented from being relatively inserted into and removed from each other in the direction in which the protrusion is projectedly formed due to engagement between the wide-width portion and the narrow-width counterpart when the upper case is in the open state.

2. A housing structure of an electronic keyboard musical instrument according to claim 1, wherein the protrusion is projectedly formed to obliquely extend upwardly and forwardly or rearwardly from the rear end portion of the lower case, the engagement hole is formed in the rear end portion of the upper case, and when the upper case is in the closed state, the protrusion and the engagement hole are prevented from being relatively inserted into and removed from each other in the direction in which the protrusion is projectedly formed due to engagement between the rear end portions of the upper and lower cases and engagement between an inclined front or rear surface of the protrusion and the engagement hole.

3. A housing structure of an electronic keyboard musical instrument according to claim 1, wherein the protrusion is projectedly formed to obliquely extend upwardly and rearwardly from the rear end portion of the lower case, the engagement hole is formed in the rear end portion of the upper case, and the upper case is adapted to be kept maintained in the open state due to engagement between the narrow-width portion of the protrusion and the narrow-width counterpart of the engagement hole and direct or indirect engagement between the rear end portion of the upper case and a rear surface of the rear end portion of the lower case when the upper case in the open state.

* * * * *